US005238463A

United States Patent [19]

Arini et al.

[11] Patent Number: 5,238,463

[45] Date of Patent: Aug. 24, 1993

[54] METHOD OF TREATING DENIM FABRIC

[75] Inventors: Catherine A. Arini, Farmington Hills; George E. Corte, Wyandotte, both of Mich.

[73] Assignee: Diversey Corporation, Mississauga, Canada

[21] Appl. No.: 573,986

[22] Filed: Aug. 27, 1990

[51] Int. Cl.[5] ..... D06L 3/02

[52] U.S. Cl. ..... 8/111; 8/101; 8/107; 252/186.28

[58] Field of Search ..... 8/111, 102, 101, 107; 252/186.27, 186.28, 186.29, 186.38, 100, 95, 142; 423/272, 273

[56] References Cited

U.S. PATENT DOCUMENTS 4,885,106 12/1989 Lapham et al. ..... 252/186.28

FOREIGN PATENT DOCUMENTS 0356950 3/1990 European Pat. Off. .

0586020 3/1947 United Kingdom .

*Primary Examiner*—Prince Willis, Jr.

*Assistant Examiner*—John F. McNally

*Attorney, Agent, or Firm*—Weintraub, DuRoss, & Brady

[57] ABSTRACT

Denim articles of clothing such as blue jeans, are conventionally treated with a permanganate. The permanganate is thereafter neutralized with a liquid composition containing peroxide, a sulfate and deionized water. The composition neutralized the permanganate, prevents the yellowing of the article and reduces the biological oxygen demand in plant effluent.

7 Claims, No Drawings

METHOD OF TREATING DENIM FABRIC

BACKGROUND OF THE INVENTION

1. Field of the Invention

The present invention pertains to methods of treating fabric. More particularly, the present invention concerns methods of treating denim fabrics. Even more particularly, the present invention relates to methods of treating "faded" denim fabrics to reduce or minimize the yellowing thereof.

2. Prior Art

The popularity of denim articles of clothing, such as "blue jeans", is well known. One particular style of denim clothing which has achieved high popularity is the "faded", "stone-washed" or "washed-out" article.

As is known to those skilled in the art to which the present invention pertains, the processing of the denim article to achieve the "faded" look involves, treating the denim article with potassium permanganate.

The permanganate is introduced into the fabric either directly or through the use of permanganate-treated rocks or stones, which are, then, tumbled together to provide the "washed-out" or "stone-washed" or "faded" effect.

To neutralize the permanganate after treatment of the articles, traditionally, an "antichlor" is applied to the denim article. The "antichlor" is introduced, also, to minimize the yellowing of the fabric after washing or similar treatment.

Generally, the "antichlors" which are used to neutralize the permanaganate are either sodium dithionate or sodium bisulfite. While the dithionates or bisulfites are efficacious for neutralizing the permanganate certain side effects detract from their desirability.

The sulfite products, when introduced into a manufacturing plant effluent, tend to cause higher biological oxygen demand (BOD) readings since these compounds are oxygen scavengers. The higher BOD readings, thus, necessitate the installation of aerators, oxygenators or similar equipment in order to raise the oxygen in the effluent to meet environmental regulations. This increases the cost of manufacturing.

It is, therefore, readily apparent that there exists a need in the art for an "antichlor" which does not unnecessarily raise BOD readings and plant effluent and which minimizes yellowing of the fabric.

SUMMARY OF THE INVENTION

In accordance with the present invention it has now been discovered that when denim articles of clothing, such as "blue jeans" or the like, are treated with a liquid comprising a peroxide and a sulfate, that yellowing of the fabric is minimized and that unusually high BOD readings are eliminated, while achieving the desirable "faded" look for the article.

The present composition, generally, comprises:

(a) a water-soluble sulfate, (b) a peroxide, and (c) water

The sulfate which is water-soluble is either (a) an alkali metal salt of a sulfate, such as for example, sodium bisulfate, potassium bisulfate or the like, or (b) the acid thereof.

The peroxide is, preferably, hydrogen peroxide.

The water is, preferably, deionized water.

The composition is applied as a solution to a permanganate-treated denim article to neutralize the permanganate.

After treatment, the excess permanganate and neutralizer are rinsed therefrom.

For a more complete understanding of the invention, reference is made to the following detailed description and accompanying examples.

DESCRIPTION OF THE PREFERRED EMBODIMENTS

In accordance herewith and as noted hereinabove the present invention provides for the application of a permanganate neutralizing composition to a denim article of clothing which has been treated with the permanganate. The permanganate neutralizing composition, generally, comprises:

(a) a water-soluble acid sulfate or salt thereof, (b) a peroxide, and (c) water.

The neutralizing compound is applied as a solution to the permanganate-treated article of clothing in order to neutralize same.

More particularly, the acid sulfate used in the practice hereof is either sulfuric acid or a water-soluble sulfate salt, such as, for example, an alkali metal sulfate, an alkali sulfate or the like. Representative of such useful sulfate salts include for example, sodium bisulfate, potassium bisulfate and the like, as well as mixtures thereof.

In the practice in the present invention, ordinarily, the sulfate is present in an amount ranging from about 5 to 25 percent, by weight, based on the total weight of the composition. Preferably, the sulfate is present in an amount ranging from about 10 to 20 percent by weight, based on the total weight of the composition.

The peroxide, as utilized herein is, generally, hydrogen peroxide. The peroxide, which is liquid, is, generally, present in an amount ranging from about 1 to 10 percent, by weight, based on the total weight of the composition and, preferably, from about 3 to 7 percent by weight, based on the total weight of the composition.

The balance of the composition is water. Preferably, the water is deionized water to preclude the presence of any salts or the like which would interfere with the neutralizing reaction between the neutralizing composition and the permanganate.

As herein above noted, it appears that the present neutralizing composition inhibits the yellowing of denim articles treated herewith. Although, not wishing to be bound by any theory, it would appear that the yellowing of the denim fabric is attributable to the formation of manganese compounds from either residual manganese compounds or from the sulfur compounds present in the conventional antichlors. Contrariwise, the neutralizing compound of the invention does not supply any sulfur compounds to the fabric, nor does it permit the presence of any yellow manganese compounds which are formed. In other words, the present composition is able to remove any yellow manganese compounds which are formed during the fabric treatment. Thus, it would appear, that the present neutralizing composition is quite effective in precluding the yellowing of denim articles of manufacture.

Likewise, because the present product is based on peroxide, it will not cause or create unnaturally high BOD readings in plant effluent.

In use, the present composition is applied as an aqueous solution to a permanganate-treated denim article, by immersing the articles in the aqueous solution. The composition is employed in excess molar quantities sufficient to neutralize the permanganate. Generally, based upon the stoichiometry, in excess of more than one mole of peroxide per mole of permanganate is employed.

Ordinarily, a total from about 3 to 12 pounds of neutralizer per hundred pounds of denim article is employed, and, preferably, a total from about 9 to 11 pounds of neutralizer per hundred pounds of denim article is employed.

Stated alternately, the neutralizer is, generally, employed in total as a 1.5% to about 4.0% weight percent aqueous solution, and, preferably as about a total 2.0% to about a 3.0% aqueous solution.

The neutralizing composition is employed at a temperature ranging from 100° to 140° F., and, preferably, at a temperature ranging from 120° to 135° F. Typically, after the quantity of denim garment is treated with a permaganate, the denim is, then, transferred to a washing machine or the like where the neutralizing procedure is carried out. After the machine is filled with water and the quantity of denium is emplaced therewithin, the neutralizing agent is added thereto and the denim garment is contacted, under agitation, with the aqueous solution for a period of from about seven to about twenty minutes and, preferably, from about ten to about fifteen minutes. Thereafter, the denim article is washed or otherwise treated with a suitable detergent, at a temperature ranging from about 120° to 140° F. This procedure of neutralizing treatment and detergent wash may then be repeated. Where the neutralizing treatment is repeated, the amount of neutralizer employed is determined by the total added to the number of aqueous solutions thereof. In other words, where two neutralizing treatments are used, then, one-half of the total amount is used in the first neutralizing treatment and one-half is used in the second treatment. Thereafter, the so-treated denim article is, then, machine-dried at a temperature of from about 125° F. to about 240° F.

The so-treated article, thus, has any permanganate neutralized and the yellowing thereof is inhibited.

For a more complete understanding of the present invention reference is made to the non-limiting examples.

In the examples all parts are by weight, absent indications to the contrary.

EXAMPLE 1

This example illustrates the preparation of a neutralizing compound in accordance with the present invention.

Into a suitable vessel is charged 66.06 parts, by weight, of deionized water. Thereafter, and with minimum agitation, there is added thereto, 12.8 parts of a 96.6 percent reagent grade liquid sulfuric acid. Thereafter, 21.4 parts of a 31.18 percent hydrogen peroxide solution is added thereto.

The composition, so-prepared, is efficacious for the neutralizing of permanganate-treated denim articles.

EXAMPLE 2

This example illustrates the use of the neutralizing composition of the present invention.

Into a washing machine is added one hundred pounds of potassium permanganate-treated denim fabric. Water maintained at 125° F. is added to the machine is a sufficient quantity to cover the fabric.

Thereafter five and one-quarter pounds of the neutralizer is added to the machine and agitation is begun. The machine is, then, run for ten minutes.

Next the water is drained from the machine and the denim fabric is washed in the machine and a suitable detergent.

Then, the neutralizing step is repeated using an additional five and one-quarter pounds of the neutralizer, followed by a further detergent washing.

After washing, the denim articles are dried at about 190° F. The so-treated denim fabric evidences no yellowing.

Having, thus, described the invention, what is claimed is:

1. A method for neutralizing permanganate used in treating permanganate-treated denim articles, comprising:

applying to the permangante-treated denim article an aqueous solution formed as a water-based solution which consists essentially of about 1.5 percent to about 4.0 percent by weight of a concentrate and water, the concentrate consisting essentially of:

(a) a water-soluble acid sulfate or water-soluble salt thereof, the sulfate being present in an amount ranging from about 5 to about 25 percent by weight, based on the total concentrate weight;

(b) a peroxide which is present in an amount ranging from about 1 percent to about 10 percent by weight, based on the total concentrate weight; and (c) water as a solvent.

2. The method of claim 1 wherein:

(a) the sulfate is sulfuric acid, (b) the peroxide is hydrogen peroxide; and (c) the water is deionized water.

3. The method of claim 1 wherein:

(a) the composition is present in the aqueous solution in an amount ranging from about 2.0 to about 3.0 percent based on the total weight.

4. A method of preventing the yellowing of denim articles of clothing comprising:

(1) treating the denim article of clothing with a permanganate compound; and (2) neutralizing the permanganate with an aqueous solution of a composition consisting essentially of about 1.5 percent to about 4.0 percent by weight of a concentrate and water, the concentrate consisting essentially of:

(a) a water soluble acid sulfate or water-soluble salt thereof; the sulfate being present in an amount ranging form about 5 percent to about 25 percent by weight, based on the total concentrate weight;

(b) a peroxide which is present in an amount from about 1 percent to about 10 percent by weight, based on the total concentrate weight; and (c) a water as a solvent.

5. The method of claim 4 wherein:

(a) the sulfate is sulfuric acid;

(b) the peroxide is hydrogen peroxide; and (c) the water is deionized water.

6. The method of claim 5 wherein:

(a) the sulfate is present in an amount ranging from 5 to 25 percent by weight based on the total weight of the composition;

(b) the peroxide is present in an amount ranging from about 1 to 10 percent by weight, based on the total weight of the composition, and (c) the balance is 4 water.

7. The method of claim 8 wherein the composition is employed as an aqueous solution, the composition being present in the solution in an amount ranging from about 2.0% to about 3.0% composition, based on the total weight of the solution.

* * * * *

UNITED STATES PATENT AND TRADEMARK OFFICE

CERTIFICATE OF CORRECTION

PATENT NO. : 5,238,463

DATED : August 24, 1993

INVENTOR(S) : Catherine A. Arini, George E. Corte

It is certified that error appears in the above-indentified patent and that said Letters Patent is hereby corrected as shown below:

Column 3, Line 25: Change "denium" to --denim--.

Column 4, Line 1: Change "is to --in--.

Column 4, Line 7: Change "and" to --with--.

Column 5, Line 4: After "is" delete --4--.

Column 5, Line 5: Replact "8" with --4--.

Signed and Sealed this

Third Day of May, 1994

Bruce Lehman

*Attest:*

BRUCE LEHMAN

*Attesting Officer*

*Commissioner of Patents and Trademarks*